United States Patent [19]

Izawa et al.

[11] 4,014,155

[45] Mar. 29, 1977

[54] COIN WRAPPING METHOD

[75] Inventors: Tsuyoshi Izawa; Masaru Itoda, both of Himeji, Japan

[73] Assignee: Glory Kogyo Kabushiki Kaisha, Hyogo, Japan

[22] Filed: Mar. 10, 1975

[21] Appl. No.: 557,011

Related U.S. Application Data

[63] Continuation of Ser. No. 363,104, May 23, 1973, abandoned.

[30] Foreign Application Priority Data

June 6, 1972 Japan ..... 47-56320

[52] U.S. Cl. ..... 53/32

[51] Int. Cl.[2] ..... B65B 11/04

[58] Field of Search ..... 53/32, 33, 30, 212, 53/211, 378, 379

[56] References Cited

UNITED STATES PATENTS

| | | | |
|---|---|---|---|
| 3,392,504 | 7/1968 | Vates | 53/33 |
| 3,412,524 | 11/1968 | Nestell et al. | 53/212 |
| 3,491,507 | 1/1970 | Warfel | 53/30 |
| 3,531,913 | 10/1970 | Uchida et al. | 53/212 |
| 3,775,940 | 12/1973 | Hatanaka | 53/212 |

*Primary Examiner*—Travis S. McGehee
*Assistant Examiner*—Horace M. Culver
*Attorney, Agent, or Firm*—Holman & Stern

[57] ABSTRACT

A predetermined number of coins in a stack are wrapped automatically in a coin wrapping apparatus with a material which is particularly adapted for wrapping coins and consisting of a highdensity polyethylene sheet. The sheet is unidirectionally predrawn in a direction coinciding with the peripheral direction of the stack of coins having a width and length exceeding the height and circumference of the stack of coins, wrapped about the stack to provide margins projecting beyond both end faces of the coin roll and the projecting margins are folded at both ends of the roll for providing crimped fold rims extending near the periphery on the roll end faces.

1 Claim, 3 Drawing Figures

FIG. 1
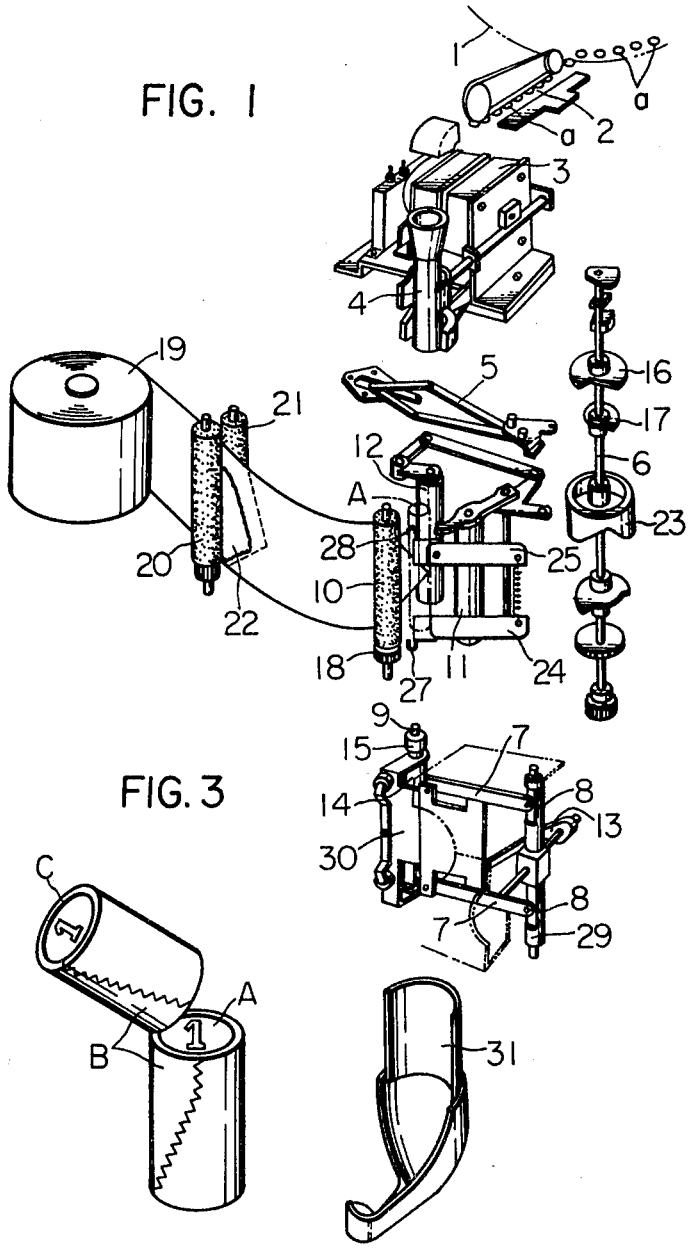
FIG. 2
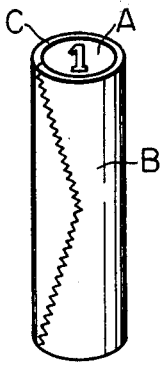
FIG. 3

COIN WRAPPING METHOD

This is a continuation of application Ser. No. 363,104 filed May 23, 1973, and now abandoned.

BACKGROUND OF THE INVENTION

This invention generally relates to a coin wrapping method, and more particularly to a coin wrapping method wherein the coins are wrapped automatically in a coin wrapping machine with a material particularly suitable for wrapping coins.

PRIOR ART

Heretofore, cellophane has been widely used for wrapping coins in wrapping machines because it normally has excellent transparency and workability. However, the market price of cellophane is somewhat high (about two times that of the polyethylene film hereinafter described), and when the wraped coins are to be removed from their wrapper, the wrapping paper cannot easily be torn open. Furthermore, cellophane has, to a considerable extent, a hygroscopic nature, which causes deterioration of workability, particularly in rainy seasons and the like.

OBJECTS AND SUMMARY OF THE INVENTION

An object of the present invention is to provide a coin wrapping method wherein a wrapping material capable of overcoming the above described disadvantages is utilized.

Another object of the invention is to provide a coin wrapping method wherein stacks of coins are wrapped automatically and consecutively.

Still another object of the invention is to provide a coin wrapping method whereby coins can be wraped to form packages which are neat in appearance, easy to handle, resistant to accidental breakage or opening, and easily openable when so desired.

These and other objects of the present invention can be achieved by an improved method for wrapping a stack of coins to form a coin roll having end faces which comprises the steps of providing a polyethylene sheet unidirectionally pre-drawn in a direction coinciding with the peripheral direction of the stack of coins having a width and length exceeding the height and circumference of the coin stack, wrapping the sheet about the stack to provide margins projecting beyond both end faces of the coin roll, and folding the projecting margins at both ends of the roll to provide crimped fold rims extending near the periphery on the roll end faces.

The invention will now be described by way of an example with reference to the accompanying drawings, in which like parts are designated by like reference numberals.

BRIEF DESCRIPTION OF THE DRAWINGS

In the drawings:

FIG. 1 is an exploded perspective view of a coin wrapping apparatus whereby the method according to the present invention can be put into practice;

FIG. 2 is a perspective view of a stack of coins wrapped in accordance with the method of this invention; and FIG. 3 is a perspective view of the stack of coins shown in FIG. 2 which is broken for opening the wrap.

DETAILED DESCRIPTION OF THE INVENTION

In a typical example of coin wrapping apparatus shown in FIG. 1 wherein the method according to the present invention is put into practice, coins a are successively supplied from a coin supplying mechanism 1 to a coin passage 2, in which coins other than the kind to be wrapped are removed and only the coins to be wraped are sent out of the passage 2 to a coin counting device 3.

In the coin counting device 3, the coins are counted, and a predetermined number thereof are introduced into a vertically disposed coin receiving tube 4 provided at the delivery side of the coin counting device 3.

At the lower opening end of the coin receiving tube 4, a shutter mechanism 5 is provided to support coins in the coin receiving tube 4. After a predetermined number of coins have been introduced into the coin receiving tube 4, the further supply of the coins is interrupted. A cam line shaft 6 is then operated, and upper and lower levers 7 which are made swingable around pivot pins 8 as described later in more detail, are swung upward, so that a guide member 9 supported by the leftward ends, as viewed in FIG. 1 of the levers 7 is elevated to a predetermined position below the center of a triangle which is defined by three rollers 10, 11, and 12, all disposed vertically.

A lever 13 is then swung upward by the rotation of the cam line shaft 6, and an auxiliary guide member 14 supported on the tip of the lever 13 is elevated higher than the guide member 9. A coin supporting portion 15 provided at the upper end of the auxiliary guide member 14 is thus elevated through the center of the triangle defined by the three rollers 10, 11, and 12 until it is brought to a position just below the shutter mechanism 5.

The shutter mechanism 5 is operated by a cam 16 for opening the lower end of the coin receiving tube 4, and a stack A of coins received in the coin receiving tube 4 is now supported on a portion 15 of an auxiliary guide member 14. Upon further rotation of the cam line shaft 6, the lever 13 interlinked therewith is now lowered, causing the auxiliary guide member 14 to descend, whereby the coin supporting portion 15 supporting the stack A of coins is lowered along a vertical line passing through the center of the triangle defined by the rollers 10, 11, and 12 until the coin supporting portion 15 descends to a position slightly lower than the upper end of the guide member 9. Thus, the stack of coins A is now supported by the guide member 9, and is located between the wrapping rollers 10, 11, and 12 at the central position of these rollers. As a result of the rotation of a cam 17 on the cam line shaft 6, movable rollers 11 and 12, which are coupled through levers and links to the cam 17, are moved toward the fixed roller 10, and the stack of coins A supported on the guide member 9 is now brought into a condition wherein they are closely embraced by the three rollers 10, 11, and 12.

After the lateral movements of the movable rollers 11 and 12 toward the fixed roller 10, all of the rollers 10, 11, and 12 are rotated simultaneously in the same direction through a gear mechanism in mesh with a gear wheel 18.

A roll 19, made of a high density polyethylene sheet unidirectionally pre-drawn in a direction coinciding with the peripheral direction of the stack and having a width and length exceeding the height and circumference of the stack, and wound in the same direction into a roll, is positioned within the coin wrapping apparatus at one side of the above described roller mechanism in a manner rotatably supported on a shaft, and one end of the roll-wound polyethylene sheet is passed between two feed rolls 20 and 21 which are driven, in an intercouple manner, together with the cam line shaft 6. The end of the polyethylene sheet is further passed into the coin wrapping rollers 10, 11, and 12 until the end reaches an inner circumferential position of the roller 12 before the stack of coins A is embraced by the three rollers 10, 11, and 12.

Thus, when the stack of coins A is closely embraced by the three rollers 10, 11, and 12 and rotated thereby, the polyethylene sheet is wound around the circumferential surface of the stack of coins A. Since the rotating speed of the coin wrapping rollers 10, 11, and 12 is faster than the rotating speed of the feed rollers 20 and 21, the polyethylene sheet is pulled under a considerable tension while it is fed from the feed rollers 20 and 21 to the coin wrapping rollers 10, 11, and 12 until it is at least cut by a knife 22 provided at an outlet position of the feed rollers 20 and 21.

The upper and lower lateral edges parallel to the feeding direction of the coin wrapping sheet wound around the circumferential surface of the stack of coins A are then tucked inwardly and folded over by hooks 27 and 28 provided at the ends of clamping levers 24 and 25, respectively, when the levers 24 and 25 are moved toward each other by a cam 23 fixed to the cam line shaft 6.

When the winding of the wrapping sheet around the circumferential surface of the stack of coins and the tucking and folding over of the lateral edges thereof as described above are completed, the levers 7, 7 are swung downwardly by the operation of the cam line shaft 6, whereby the guide member 9 supported by the ends of the levers 7, 7 is lowered from the underside position of the stack of coins. A rotatable shaft 29 is then rotated around its vertical axis in cooperation with the cam line shaft 6, whereby the levers 7, 7 and hence the guide member 9 are retracted from the position below the stack of coins to a sideward position, and a guide frame 30 is returned to its original position under the action of a spring (not shown).

When the cam line shaft 6 is rotated to a predetermined position, the movable rollers 11 and 12 are separated from the fixed roller 10, and the stack of coins now wrapped with the coin wrapping sheet is allowed to drop into a guiding chute 31 provided below the coin wrapping position of the coin wrapping apparatus.

The stack of coins thus wrapped with the coin wrapping sheet is illustrated in FIG. 2. As is apparent from the drawing, the stack of coins A is wrapped on the circumferential surface thereof with the polyethylene sheet B, and the upper and lower edges of the sheet B are formed into peripheral rims C tucked and folded over the uppermost and lowermost coins, respectively.

Since the stack of coins is wrapped, according to the present invention, with a high-density polyethylene sheet which has been unidirectionally pre-drawn in a direction coinciding with the peripheral direction of the stack and the upper and lower edges of the film are tucked and folded over as described above, the wrapped sheet can be broken as shown in FIG. 3 in a far easier manner than in the conventional practice wherein the coins are wrapped with a cellophane sheet when an impact is applied to the thus wrapped coin stack in a direction perpendicular to the axis of the coin stack.

Furthermore, since the upper and lower edges of the coin wrapping sheet are tucked and folded over as described above, there is no possibility of the edge being loosened by the resilience of the wrapping material, whereby a firm wrapping of the stack of coins is assured.

The above described advantages of the coin wrapping high-density polyethylene sheet drawn in the direction stated are due to the following reasons.

The high-density polyethylene is a polymer of a paraffin-chain structure ($-CH_2 - CH_2 -$) and of a density ranging from 0.95 to 0.96. The polyethylene has far less side chains or branches in comparison with the low-density polyethylene having a density of approximately 0.92, and the intermolecular distance of the former is shorter than that of the latter. The degree of crystallinity in the high-density polyethylene ranges from 90 to 95% whereas the degree of crystallinity of the lower density polyethylene is approximately 65%.

When such a high-density polyethylene is drawn as stated into a sheet, linear molecules thereof are extended in parallel with each other along their molecular chains, and the sheet thus obtained has a high tensile strength in the drawn direction but can be easily torn in the transverse direction.

Thus, when the high-density polyethylene sheet is wound around the circumferential surface of a stack of coins such that the unidirectionally see-drawn direction of the polyethylene film coincides with the circumferential direction of the stack of coins, the stack of coins thus wrapped can be easily broken by the application of an impact transverse to the circumferential direction.

In the case where the sheet is wound in the form of a supplying roll or when the sheet is wound around the circumferential surface of the stack of coins, tensions are applied along the unidirectionally see-drawn direction of the polyethylene sheet whereby there is almost no possibility of breaking the sheet.

However, because of the comparatively high stiffness of the high-density polyethylene sheet, the sheet can be easily cut into a required length by a cutter which applies a cutting force transversely to the unidirectionally see-drawn direction of the polyethylene film.

Whenever the lateral edges of the coin wrapping sheet are tucked and folded over by the hooks, the tucked portions of the sheet tend to spring back and be loosened because of the resilience of the coin wrapping sheet. High-density polyethylene has a greater stiffness than polypropylene or vinyl chloride because of the high density and high crystallinity while it has a lower resilience than these materials. Furthermore, the unidirectionally pre-drawn high-density polyethylene sheet has a molecular orientation which is unidirectionally pre-dense, and its resilience against a twisting force is remarkably low. For this reason, if a twisting force exceeding a certain value is applied to the uniaxially drawn high-density polyethylene sheet, the sheet yields permanently and undergoes plastic deformation.

Accordingly, when the upper and lower edges of the polyethylene sheet wound around the circumferential surface of the stack of coins in a cylindrical configuration are tucked inwardly by the hooks as described hereinbefore, there is no possibility of the thus tucked edges being loosened by the resilience of the wrapping sheet, whereby the upper and lower edges of the polyethylene sheet can be maintained in the tucked state.

In addition, because of the high stiffness of the high-density and high crystallinity polyethylene sheet, there is no possibility of the wrapping sheet being broken of worn out during the wrapping operation and the handling thereafter.

Although the transparency of the high-density polyethylene sheet is inferior to that of the low-density polyethylene sheet because of the higher crystallinity, this shortcoming can be amply compensated for by selecting the cooling condition and the drawing condition at the time of the unidirectional drawing operation.

We claim:

1. In a method for wrapping a coin-stack to form a coin-roll having end faces, wherein a coin-stack held between wrapping rolls adapted for holding and rotating the coin-stack is wrapped with a resinous sheet and projecting upper and lower lateral edges of the sheet are crimp-folded in over respective ends of the coin-stack to provide a coin-roll, the improvement comprising the steps of providing, as the wrapping sheet, a polyethylene sheet which is unidirectionally pre-drawn in a direction coinciding with the peripheral direction of the coin-stack and fed from a supply source to between the wrapping rolls and the coin-stack, holding the polyethylene sheet under tension during wrapping of the sheet about the coin-stack, wrapping the polyethylene sheet around the coin-stack so that the axial direction of the unidirectional drawing of the sheet is caused to coincide with the coin surface plane of the coin-stack, and effecting tucking of the projecting lateral edges of the sheet in a direction parallel to the axial direction of the unidirectional drawing of the sheet.

* * * * *